US010654267B2

(12) United States Patent
Fukuda

(10) Patent No.: US 10,654,267 B2
(45) Date of Patent: May 19, 2020

(54) LIQUID DISCHARGING APPARATUS

(71) Applicant: SEIKO EPSON CORPORATION, Tokyo (JP)

(72) Inventor: Shunya Fukuda, Azumino (JP)

(73) Assignee: Seiko Epson Corporation, Tokyo (JP)

( * ) Notice: Subject to any disclaimer, the term of this patent is extended or adjusted under 35 U.S.C. 154(b) by 59 days.

(21) Appl. No.: 15/664,370

(22) Filed: Jul. 31, 2017

(65) Prior Publication Data

US 2018/0056651 A1 Mar. 1, 2018

(30) Foreign Application Priority Data

Aug. 29, 2016 (JP) ..... 2016-166556

(51) Int. Cl.
*B41J 2/045* (2006.01)
*B41J 2/165* (2006.01)

(52) U.S. Cl.
CPC ..... *B41J 2/04588* (2013.01); *B41J 2/04581* (2013.01); *B41J 2/04586* (2013.01); *B41J 2/04593* (2013.01); *B41J 2/16517* (2013.01); *B41J 2/16526* (2013.01); *B41J 2/16535* (2013.01)

(58) Field of Classification Search
CPC ..... B41J 2/04588; B41J 2/04581; B41J 2/16535; B41J 2/04508; B41J 2/0451; B41J 2/04583; B41J 2/04596; B41J 2/04598
See application file for complete search history.

(56) References Cited

U.S. PATENT DOCUMENTS 5,625,384 A * 4/1997 Numata ..... B41J 2/0451 347/19
2006/0181568 A1* 8/2006 Aoki ..... B41J 2/16508 347/30
2007/0057997 A1* 3/2007 Mizutani ..... B41J 2/1433 347/45
2011/0084996 A1* 4/2011 Hirato ..... B41J 2/0451 347/10
2014/0253618 A1* 9/2014 Masuda ..... B41J 2/04581 347/10

(Continued)

FOREIGN PATENT DOCUMENTS

JP 2016-87954 A 5/2016

*Primary Examiner* — Alessandro V Amari
*Assistant Examiner* — Kendrick X Liu
(74) *Attorney, Agent, or Firm* — Workman Nydegger

(57) ABSTRACT

A liquid discharging apparatus includes a liquid discharging head having an actuator, a nozzle-formed surface on which a nozzle opens and discharging liquid from the nozzle by activating the actuator, and an activation pulse generation circuit that generates an activation pulse for activating the actuator. The nozzle-formed surface has a liquid repellent film formed thereon. The activation pulse includes a first pull-in component that pulls a meniscus in the nozzle from an initial position of the meniscus, a first push-out component that pushes the meniscus that has been pulled, a second pull-in component that pulls the meniscus that has been pushed, and a second push-out component that pushes at least a portion of the meniscus that has been pulled again. The nozzle discharges a special-type liquid. The special-type liquid is a type of liquid that relatively tends to cause repellency of the liquid repellent film to deteriorate.

5 Claims, 9 Drawing Sheets

(56) References Cited

U.S. PATENT DOCUMENTS

| | | | | |
|---|---|---|---|---|
| 2015/0035885 | A1* | 2/2015 | Fukuda | B41J 2/04588<br>347/10 |
| 2017/0066236 | A1* | 3/2017 | Sohgawa | B41J 2/04573 |

* cited by examiner

LIQUID DISCHARGING APPARATUS

The entire disclosure of Japanese Patent Application No. 2016-166556, filed Aug. 29, 2016 is expressly incorporated by reference herein.

BACKGROUND

1. Technical Field

The present invention relates to liquid discharging apparatuses, such as ink jet type recording apparatuses, and more specifically to liquid discharging apparatuses that discharge liquid from nozzles by activating actuators and generating pressure vibrations in liquid in liquid flow paths.

2. Related Art

A liquid discharging apparatus is an apparatus that has a liquid discharging head having nozzles that discharge (or eject) various liquids. A typical example of the liquid discharging apparatus is an image recording apparatus, such as an ink jet type printer or an ink jet type plotter. The liquid discharging apparatus, which enables a very small amount of liquid to strike precisely at a predetermined position, has also been advantageously applied to various manufacturing apparatuses in recent years. For example, the liquid discharging apparatus has been applied to a display manufacturing apparatus that manufactures color filters for liquid crystal displays, etc., an electrode forming apparatus that forms electrodes for organic electroluminescence displays and field emission displays, etc., and a chip manufacturing apparatus that manufactures biochips. The image recording apparatus has a recording head that discharges liquid ink, whereas the display manufacturing apparatus has a coloring material discharge head that discharges solutions of coloring materials, including red (R), green (G), and blue (B), from nozzles. The electrode forming apparatus has an electrode material discharge head that discharges liquid electrode materials, and the chip manufacturing apparatus has a bioorganic material discharge head that discharges bioorganic material solutions from nozzles.

Liquid droplets discharged from the nozzles of such a liquid discharging head are very small, i.e., in a range of several nanograms to several tens of nanograms. Discharging the liquid droplets generates a mist of even smaller particles, which may adhere to a nozzle-formed surface of the liquid discharging head. The liquid discharging apparatus having the liquid discharging head is formed so as to perform maintenance processing in which nozzles are forced to discharge viscous liquid and bubbles by applying negative pressure to the nozzles while the nozzle-formed surface is sealed with a cap, i.e., a sealing member. In this maintenance processing, liquid may adhere to the nozzle-formed surface. To remove liquid and foreign matter that adhere to the nozzle-formed surface, a typical liquid discharging apparatus is equipped with a sweeping mechanism that sweeps the nozzle-formed surface with a sweeping member, such as a wiper. Moreover, in order to improve efficiency in sweeping the nozzle-formed surface by using the sweeping mechanism, a liquid repellent film is formed on the nozzle-formed surface of the liquid discharging head, thereby improving liquid repellency and durability of the nozzle-formed surface (for example, see JP-A-2016-087954).

However, for a liquid discharging head that discharges, for example, liquid containing a pigment or an inorganic material, the liquid adheres to the nozzle-formed surface and deposits the pigment and inorganic material, etc., thereon. In this state, when the nozzle-formed surface is swept by the wiping mechanism, the liquid repellent film may be scratched, i.e., mechanically damaged, which leads to deterioration of the liquid repellent film. In particular, the deterioration of the liquid repellent film changes the contact angle and the contact circumference, etc., of a meniscus with respect to the inner surface of the nozzle. This has sometimes had a negative impact on liquid discharge. The same problem occurs in a liquid discharging apparatus that discharges a liquid that may chemically damage the liquid repellent film. The above patent document, JP-A-2016-087954, proposes a configuration in which nozzles that discharge a liquid that may cause the liquid repellent film to deteriorate are mounted in the liquid discharging head at a position closest to an electrostatic suction mechanism for sucking the mist. However, this configuration cannot prevent the liquid from adhering to the nozzle-formed surface during the maintenance processing. Therefore, this approach is not sufficient.

SUMMARY

An advantage of some aspects of the invention is that a liquid discharging apparatus that can reduce the influence of deterioration of a liquid repellent film on liquid discharge is provided.

A liquid discharging apparatus according to an aspect of the invention includes a liquid discharging head having an actuator, a nozzle-formed surface on which a nozzle opens and discharging liquid from the nozzle by activating the actuator, and an activation pulse generation circuit that generates an activation pulse for activating the actuator. In the liquid discharging apparatus, the nozzle-formed surface has a liquid repellent film formed thereon. In addition, the activation pulse includes a first pull-in component that pulls a meniscus in the nozzle from an initial position of the meniscus toward an upstream side with respect to a discharge direction, a first push-out component that pushes, toward a downstream side with respect to the discharge direction, the meniscus that has been pulled, a second pull-in component that pulls, toward the upstream side again, the meniscus that has been pushed, and a second push-out component that pushes, toward the downstream side again, at least a portion of the meniscus that has been pulled again. In addition, in the liquid discharge apparatus, the actuator corresponding to the nozzle that discharges a special-type liquid, among liquids to be discharged by the liquid discharging head, is activated by the activation pulse. Here, the special-type liquid is a type of liquid that relatively tends to cause repellency of the liquid repellent film to deteriorate.

In accordance with this configuration, the actuator corresponding to the nozzle that discharges the special-type liquid is activated by the activation pulse that includes the first pull-in component, the first push-out component, the second pull-in component, and the second push-out component. Thus, the liquid is first pressurized by the first pull-in component and the first push-out component. The center of the meniscus, which can move readily in response to the pressure change, is primarily pulled upstream in the nozzle by the second pull-in component. Subsequently, the second push-out component pushes the center of the meniscus that responds readily to the pressure change. As a result, while the meniscus is located more upstream in the nozzle with respect to the liquid discharge direction, the center of the meniscus is primarily discharged. Thus, even if the liquid repellent film surrounding the nozzle deteriorates, the nozzle can discharge the special-type liquid without being influenced by the deterioration. As a result, the reliability in liquid discharge in the liquid discharging apparatus can be maintained for a longer period of time.

The above configuration is applicable where the special-type liquid has a static contact angle with the liquid repellent film and the static contact angle is smaller than the static contact angle of other liquids.

With this configuration, the special-type liquid has a smaller static contact angle with the liquid repellent film than the static contact angle of other liquids, and thus the liquid repellent film has a higher degree of wettability for the special-type liquid. The special-type liquid tends to damage the liquid repellent film mechanically or chemically. The actuator corresponding to the nozzle that discharges the special-type liquid is activated by the activation pulse. As a result, even if the liquid repellent film surrounding the nozzle deteriorates, the nozzle can discharge the special-type liquid without being influenced by the deterioration.

The above configuration is also applicable where the special-type liquid is a liquid to which foreign matter tends to adhere compared with other liquids.

With this configuration, the special-type liquid to which the foreign matter tends to adhere damages the liquid repellent film more than other liquids. The actuator corresponding to the nozzle that discharges this special-type liquid is activated by the activation pulse. As a result, even if the liquid repellent film surrounding the nozzle deteriorates, the nozzle can discharge the special-type liquid without being influenced by the deterioration.

The above configuration is also applicable where the special-type liquid contains a pigment or an inorganic material.

With this configuration, the special-type liquid containing the pigment or the inorganic material tends to damage the liquid repellent film mechanically. The actuator corresponding to the nozzle that discharges the special-type liquid is activated by the activation pulse. As a result, even if the liquid repellent film surrounding the nozzle deteriorates, the nozzle can discharge the special-type liquid without being influenced by the deterioration.

Moreover, the above configuration is applicable where the special-type liquid is more corrosive to the liquid repellent film than other liquids.

With this configuration, the special-type liquid that is more corrosive to the liquid repellent film tends to damage the liquid repellent film chemically. The actuator corresponding to the nozzle that discharges this special-type liquid is activated by the activation pulse. As a result, even if the liquid repellent film surrounding the nozzle deteriorates, the nozzle can discharge the special-type liquid without being influenced by the deterioration.

In the above configuration, it is desirable that the actuator corresponding to the nozzle that discharges other liquids be activated by the activation pulse or another activation pulse until a predetermined pulse-switching condition is satisfied, and the actuator be exclusively activated by the activation pulse after the predetermined pulse-switching condition is satisfied. Here, "the actuator be exclusively activated by the activation pulse" means that the actuator is activated in principle only by the activation pulse but this does not exclude exceptional cases in which the actuator is activated by another activation pulse.

With this configuration, the liquid repellent film surrounding a nozzle that discharge a liquid other than the special-type liquid may also deteriorate gradually due to the adhesion of the special-type liquid. Thus, the nozzle can discharge other liquids without being influenced by the deterioration of the liquid repellent film by exclusively using the activation pulse after a predetermined pulse-switching condition is satisfied.

In the above configuration, it is desirable that the liquid discharging apparatus further include a sweeping mechanism that sweeps the nozzle-formed surface, and the pulse-switching condition be the predetermined number of wipes to be performed on the nozzle-formed surface by the sweeping mechanism.

With this configuration, the special-type liquid that adheres to the nozzle-formed surface may move on the nozzle-formed surface when the nozzle-formed surface is swept by the sweeping mechanism, which may cause a gradual deterioration of the liquid repellent film that surrounds the nozzle discharging other liquids. Thus, setting the predetermined number of wipes as the pulse-switching condition enables timelier switching to the activation using the activation pulse.

In the above configuration, a sealing mechanism that seals the nozzle-formed surface can be adopted.

With this configuration, the special-type liquid adheres to a contact portion of the sealing mechanism that comes into contact with the nozzle-formed surface. When the sealing mechanism seals the nozzle-formed surface, the special-type liquid may further adhere to the nozzle-formed surface. Sweeping by the sweeping mechanism may cause a gradual deterioration of the liquid repellent film surrounding the nozzle that discharges other liquids. With this configuration, the nozzle can discharge other liquids without being influenced by the deterioration of the liquid repellent film by switching to the activation using the activation pulse on the basis of the pulse-switching condition.

BRIEF DESCRIPTION OF THE DRAWINGS

The invention will be described with reference to the accompanying drawings, wherein like numbers reference like elements.

DESCRIPTION OF EXEMPLARY EMBODIMENTS

Exemplary embodiments will be described with reference to the accompanied drawings. Note that although various limitations will be included in the description of exemplary embodiments in order to describe preferred examples, such particular configurations should not be construed as limitations with respect to the scope of the invention unless expressly stated otherwise. Also note that an ink jet type recording apparatus (hereinafter referred to as "printer") will be described as an example of a liquid discharging apparatus according to the invention.

Figure 1:
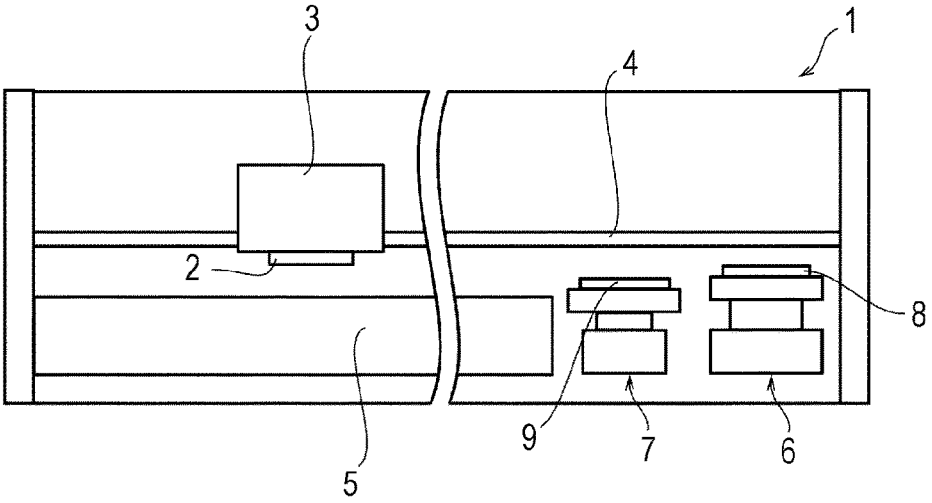
FIG. 1 is a front view illustrating an internal configuration of a printer.
Figure 2:
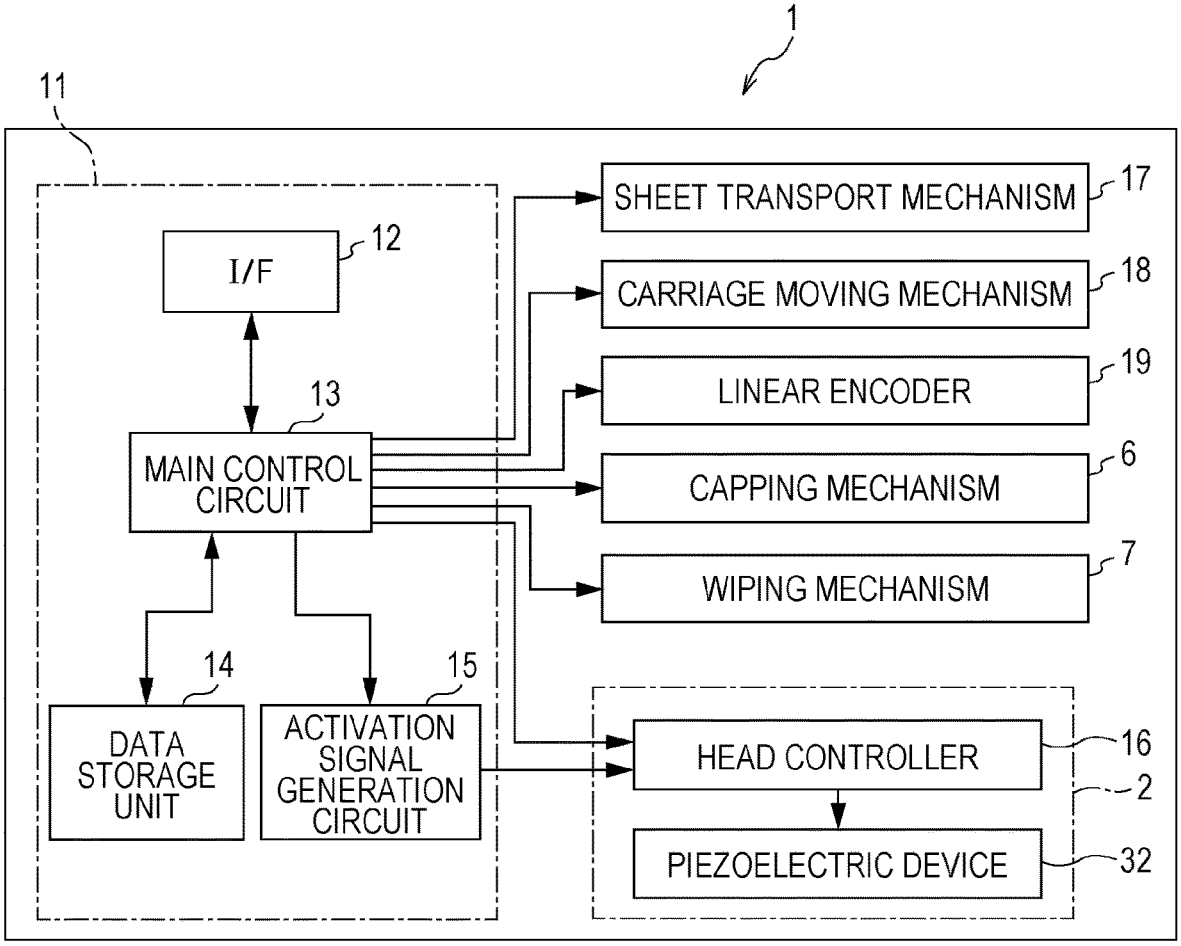
FIG. 2 is a block diagram illustrating an electrical configuration of the printer.

FIG. 1 is a front view illustrating an internal configuration of a printer 1, and FIG. 2 is a block diagram illustrating an electrical configuration of the printer 1. A recording head 2, which is a type of liquid discharging head, is attached to the bottom of a carriage 3 that has ink cartridges (or liquid supply sources) mounted thereon. The carriage 3 is formed such that a carriage-moving mechanism 18 can move the carriage 3 in a reciprocating manner along a guide rod 4. More specifically, while the printer 1 transports recording media one by one to a platen 5 by using a sheet transport mechanism 17 and moves the recording head 2 in the width direction (i.e., the main scanning direction) with respect to a recording medium, the printer 1 records images, etc., on the recording medium by discharging ink, which is a type of liquid according to the invention, from nozzles 35 of the recording head 2 (see FIG. 5) and by causing the ink to strike on the recording medium. Note that the printer 1 can be formed such that the ink cartridges are disposed in the printer body, instead of on the recording head 2, and ink is supplied from the ink cartridges to the recording head 2 through supply tubes.

In the printer 1 according to the embodiment, inks such as those including, for example, color materials and solvents for dispersing or dissolving the color materials are used. For example, the color materials are pigments, and the following pigments can be used: azo pigments, such as insoluble azo pigments, condensed azo pigments, azo lakes, and chelate azo pigments; polycyclic pigments, such as phthalocyanine pigments, perinone and perylene pigments, anthraquinone pigments, quinacridone pigments, dioxane pigments, thioindigo pigments, isoindolinone pigments, quinophthalone pigments; and dye chelates, color lakes, nitro pigments, nitroso pigments, aniline black, daylight fluorescent pigments, carbon black, base metal pigments, and the like. In addition, inorganic materials (for black pigments), such as copper oxide and manganese dioxide, as well as inorganic materials (for white pigments), such as zinc oxide, titanium oxide, antimony trioxide, and zinc sulfide can also be used as pigments. Moreover, dyes, such as direct dyes, acid dyes, food colorants, basic dyes, reactive dyes, disperse dyes, vat dyes, soluble vat dyes, and reactive disperse dyes, can be used. As solvents for aqueous inks, pure water or ultrapure water, such as ion-exchanged water, ultrafiltered water, reverse osmosis water, and distilled water, can be used. As solvents for oil-based inks, those including volatile organic compounds, such as ethylene glycol and propylene glycol, can be used. In addition to the color materials and the solvents, ink may also contain basic catalysts, surface-active agents, tertiary amines, thermoplastic resins, pH-regulating agents, buffer solutions, fixing agents, preservatives, oxidation inhibitors, UV absorbers, chelating agents, oxygen absorbents, and the like.

Among these inks, a type of ink that tends to damage the repellency of a liquid repellent film 29, which is formed on a nozzle-formed surface of the recording head 2 (i.e., a lower surface of a head unit 20 that opposes a platen 5 and is constituted by a nozzle plate 30 and a head cover 23 in the embodiment), is hereinafter referred to as a special-type ink (that corresponds to a special-type liquid according to the invention). In particular, an ink that contains an inorganic material as described above can be included in the category of the special-type ink because such an ink tends to damage the liquid repellent film 29 (see FIG. 6) when the nozzle-formed surface is swept by a wiping mechanism 7 while such an ink adheres to the nozzle-formed surface. In addition, an oil-based ink can be included in the category of the special-type ink. The oil-based ink has a small static contact angle compared with other inks. In other words, the liquid repellent film 29 has a higher degree of wettability for this type of ink so that the liquid repellent film 29 does not exhibit (or tends to lose) originally intended liquid repellency. In addition, an ink containing, for example, a resin material such as thermoplastic resin particles can also be included in the special-type ink because it is easier for foreign matter (such as paper dust) to adhere to such an ink than to other inks, which tends to damage the liquid repellent film 29 when the wiping mechanism 7 sweeps the nozzle-formed surface. Such a thermoplastic resin material may include resin components similar to dispersant resins or resin emulsions that have hitherto been used in inks for printers. Moreover, an ink that has a higher alkalinity or acidity than other inks can be included in the category of the special-type ink because such an ink tends to chemically degrade (or corrode) the liquid repellent film 29 compared with other inks.

Inside the printer 1, a home position at which the recording head 2 stands by is disposed at a position aside from one end (on the right-hand side in FIG. 2) of the platen 5 in the main scanning direction. At the home position, a capping mechanism 6 (i.e., a type of sealing mechanism in the invention) and the wiping mechanism 7 (i.e., a type of sweeping mechanism in the invention) are disposed in this order from the one end. The capping mechanism 6, for example, has a cap 8 formed of an elastic material, such as an elastomer. The capping mechanism 6 is formed so as to be able to switch between a sealing state (or capping state) in which the cap 8 abuts and seals the nozzle-formed surface of the recording head 2 and a standby state in which the cap 8 is separated from the nozzle-formed surface. In the capping mechanism 6, the space within the cap 8 serves as a sealing space. The nozzle-formed surface is sealed while nozzles 35 of the recording head 2 are present within the sealing space. A pump unit (i.e., a type of suction device) (not shown) is connected to the capping mechanism 6. Operation of the pump unit can provide the sealing space with a negative pressure. Operation of the pump unit with the cap 8 being in close contact with the nozzle-formed surface causes a negative pressure in the sealing space and consequently the ink and bubbles within the recording head 2 are sucked from the nozzles 35 and discharged into the sealing space of the cap 8. The discharged ink in the sealing space is further discharged into a waste liquid tank (not shown) via a waste liquid tube that is connected to the cap 8. A series of these processes conducted by the capping mechanism 6 is called suction-type cleaning processing (hereinafter simply called "cleaning processing"). Alternatively, the cleaning processing may be conducted by means of pressure-type cleaning processing, in which ink supply paths located upstream (on the side of ink cartridges) of the recording head 2 are pressurized by means of, for example, an air pump so as to pressurize flow paths in the recording head 2. Thereby, ink that has been viscous is discharged from the nozzles 35 to recover the ink discharging capability of the nozzles 35.

The wiping mechanism 7 according to the embodiment has a wiper 9 that is slidable in a direction intersecting the main scanning direction, in other words, in a row arrangement direction of nozzle rows of the head unit 20, which will be described below. The wiper 9 is formed, for example, of an endless belt having a surface covered with cloth or of a blade-shaped member made of an elastic material such as an elastomer. The wiping mechanism 7 is formed so as to be able to switch between an abutting state in which the wiper 9 abuts the nozzle-formed surface of the recording head 2 and a standby state in which the wiper 9 is separated from the nozzle-formed surface. The wiping mechanism 7 sweeps the nozzle-formed surface by sliding the wiper 9 with the wiper 9 abutting the nozzle-formed surface. Note that various configurations may be adopted to form the wiper 9.

In the printer 1 according to the embodiment, a printer controller 11 controls various units. The printer controller 11 according to the embodiment has an interface (I/F) unit 12, a main control circuit 13, a data storage unit 14, an activation signal generation circuit 15 (that corresponds to an activation pulse generation circuit according to the invention). The interface unit 12 receives print data and print commands from an external apparatus, such as a computer and a portable information terminal, and outputs status information of the printer 1 to the external apparatus. The data storage unit 14, which includes a read-only memory (ROM), a random access memory (RAM), and a nonvolatile random access memory (NVRAM), is a device for storing program data for the main control circuit 13 and control data to be used for various controls.

The main control circuit 13 controls each unit in accordance with the program stored in the data storage unit 14. When recording is performed, the main control circuit 13 according to the embodiment also generates discharge data that indicates the nozzles 35 of the recording head 2 from which ink is discharged (see FIG. 5, for example) and the timing at which ink is discharged. The main control circuit 13 sends the discharge data to a head controller 16 of the recording head 2. In addition, the main control circuit 13 generates timing pulses PTS from encoder pulses output from a linear encoder 19. In synchronization with the timing pulses PTS, the main control circuit 13 controls transfer of print data, generation of activation signals in the activation signal generation circuit 15, and so on. Moreover, the main control circuit 13 generates timing pulses such as latch signals LAT on the basis of the timing pulses PTS and outputs them to the head controller 16 of the recording head 2. In accordance with the discharge data and the timing signals, the head controller 16 selectively applies activation pulses contained in the activation signals to piezoelectric devices 32 (see FIG. 4). Thereby, the piezoelectric devices 32 are activated so as to discharge ink droplets from the nozzles 35 or to perform micro-vibration operation in a manner such that ink droplets are not discharged. The activation signal generation circuit 15 generates activation signals that include activation pulses (to be described below) for recording images, etc., by discharging ink droplets onto a recording medium.

As illustrated in FIG. 2, the printer 1 according to the embodiment includes a sheet transport mechanism 17, the carriage-moving mechanism 18, a linear encoder 19, the capping mechanism 6, the wiping mechanism 7, the recording head 2, and others. The carriage-moving mechanism 18 is formed mainly of the carriage 3 having the recording head 2 mounted thereon and a drive motor (for example, a DC motor) for moving the carriage 3 via a timing belt, etc., (not shown) so as to move the recording head 2 that is mounted on the carriage 3 in the main scanning direction. The sheet transport mechanism 17, which includes a sheet transport motor and sheet transport rollers (neither of which are shown), etc., transports recording media one by one to the platen 5 and performs subscanning. The linear encoder 19 generates an encoder pulse that corresponds to the scanning position of the recording head 2 mounted on the carriage 3 and outputs it to the printer controller 11 as position information in the main scanning direction. The main control circuit 13 of the printer controller 11 can identify the scanning position (or current position) of the recording head 2 in accordance with the encoder pulse received from the linear encoder 19.

Next, a configuration of the recording head 2 will be described.

Figure 3:
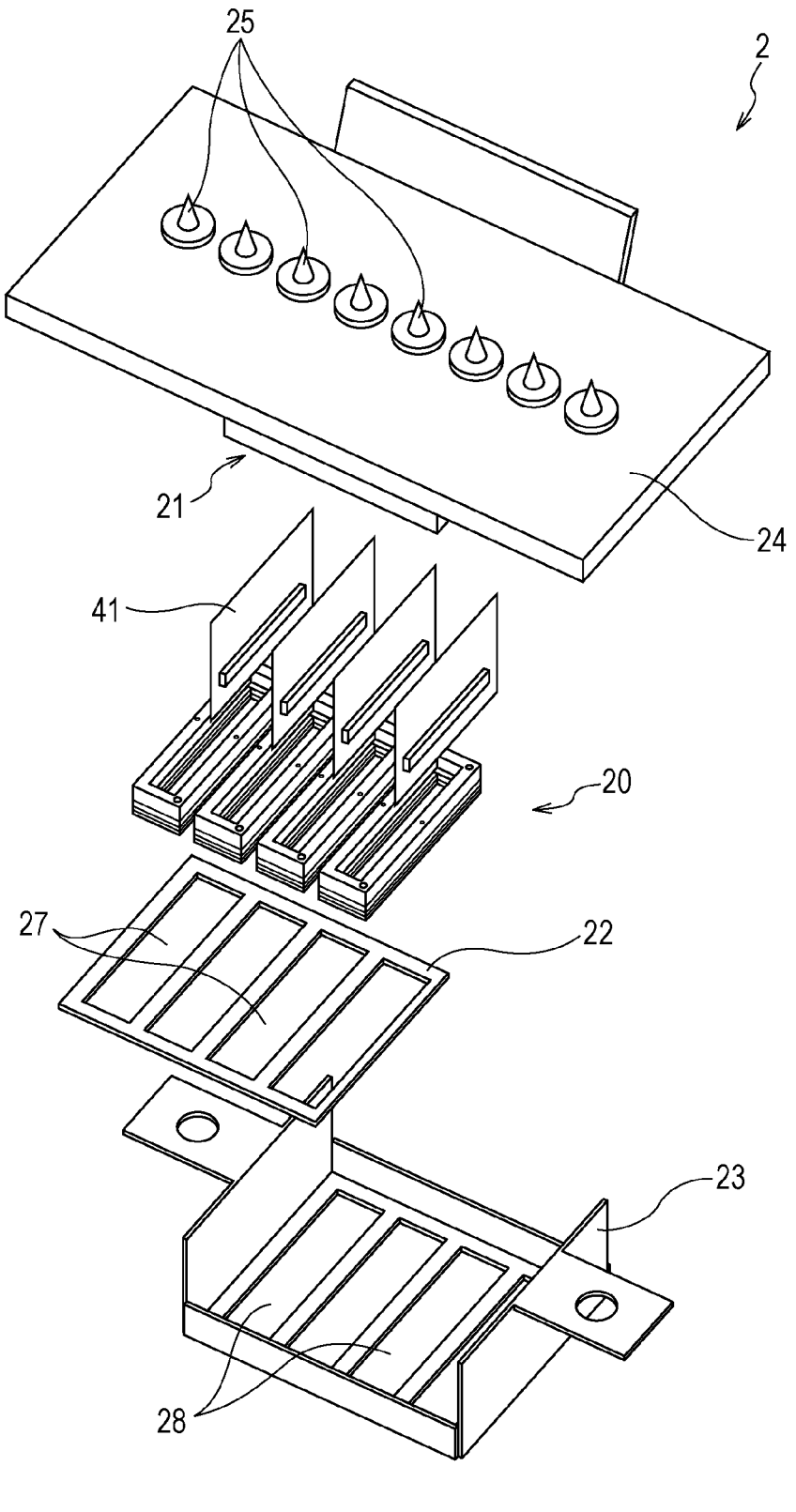
FIG. 3 is an exploded perspective view of a recording head.
Figure 4:
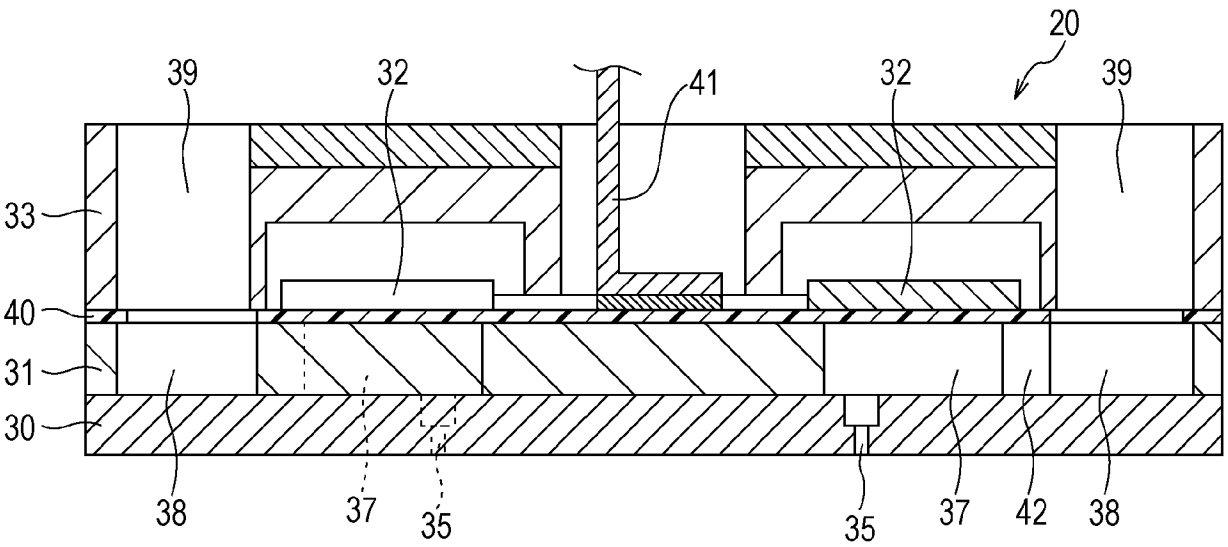
FIG. 4 is a cross-sectional view illustrating a configuration of a head unit.
Figure 5:
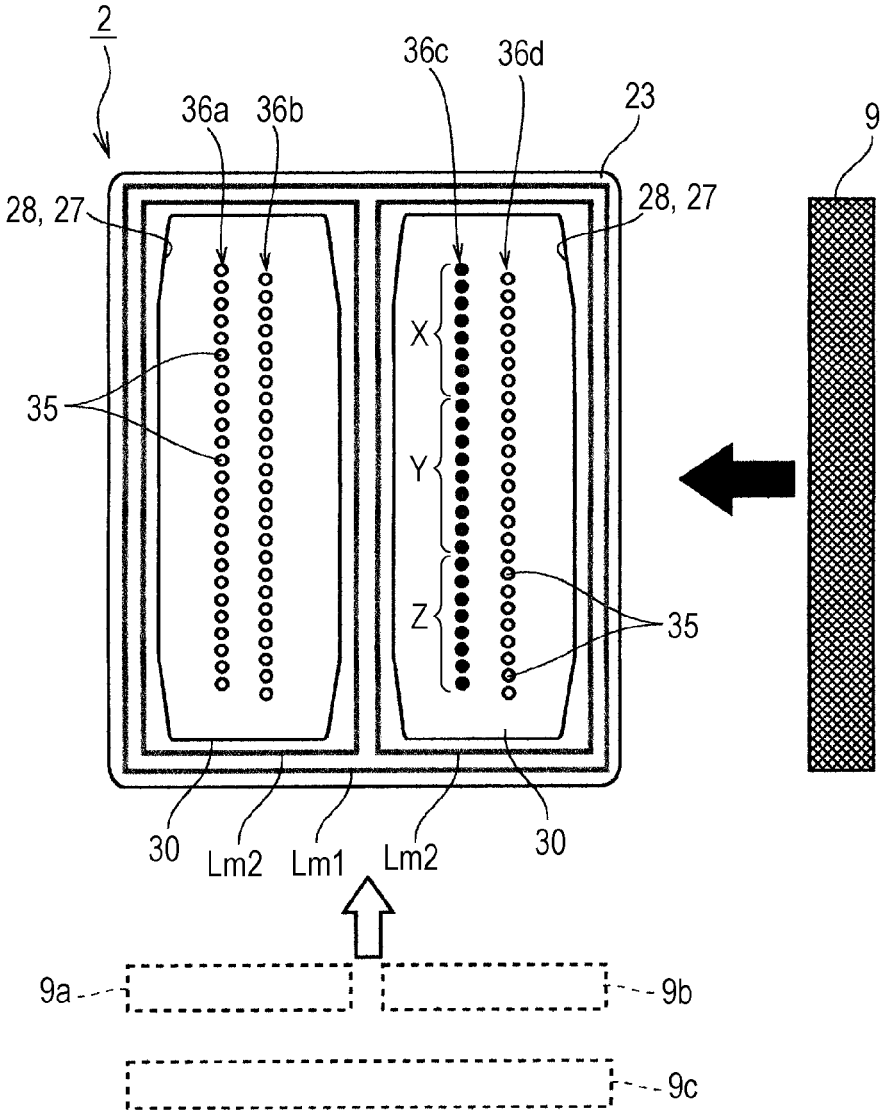
FIG. 5 is a plan view illustrating a configuration of a nozzle-formed surface.

FIG. 3 is an exploded perspective view illustrating a configuration of the recording head 2 according to the embodiment, and FIG. 4 is a cross-sectional view illustrating a configuration of the head unit 20. In addition, FIG. 5 is a plan view illustrating a configuration of the nozzle-formed surface of the recording head 2. The recording head 2 according to the embodiment includes a head case 21, a plurality of the head units 20, a unit-fixation plate 22, and the head cover 23. The head case 21 is a box-shaped member for containing the head units 20 and supply flow paths (not shown) for supplying ink to the head units 20. An ink introduction unit 24 is formed on the top side of the head case 21. The ink introduction unit 24 according to the embodiment is a member on which ink introduction styluses 25 are erected. In the embodiment, a total of eight ink introduction styluses 25 are arranged side by side on the ink introduction unit 24 in the main scanning direction. The ink introduction styluses 25 are members shaped like hollow styluses, which are to be connected to ink cartridges (not shown). Ink contained in the ink cartridges is introduced from the ink introduction styluses 25 into the supply flow paths within the head case 21 and further into respective head units 20 through the supply flow paths. Note that the ink introduction unit 24 is not limited to the configuration in which the ink introduction styluses 25 are inserted in respective ink cartridges. The ink introduction unit 24 can be formed such that a porous member is provided in each of ink discharge outlets of the ink cartridges as well as in respective ink supply ports of the ink introduction unit 24, and ink is transferred by bringing these porous members into contact with each other.

In the embodiment, a total of four head units 20 are provided on the bottom side of the head case 21. The four head units 20 are joined to the unit-fixation plate 22 that is made of a metal and has four openings 27 corresponding to respective head units 20 in such a manner that the head units 20 are positioned side by side in the main scanning direction. The head units 20 are also fixed by means of the metal head cover 23 that also has four openings 28 corresponding to respective head units 20. Thus, a nozzle plate 30 of each of the head units 20 that are fixed to the head case 21 is exposed in the openings 27 and 28.

As illustrated in FIG. 4, each head unit 20 according to the embodiment mainly includes the nozzle plate 30, a flow-path substrate 31, and piezoelectric devices 32. The head unit 20 is attached to a case 33 with these members in a layered state. The nozzle plate 30 is a plate-shaped member through which a plurality of nozzles 35 are formed. The nozzles 35 are arranged in rows and have a predetermined spacing therebetween in a direction intersecting the main scanning direction (in other words, in the subscanning direction). The nozzle plate 30 is made, for example, of a silicon substrate or a metal plate material. As illustrated in FIG. 4 and FIG. 5, in the nozzle plate 30 according to the embodiment, two nozzle rows (or nozzle groups) 36, each of which is formed of a plurality of the nozzles 35, are provided side by side in the main scanning direction. Each of these nozzle rows 36 is formed so as to discharge a different type (or different color) of ink. A surface of the nozzle plate 30, from which the nozzles 35 discharge ink, constitutes a portion of the nozzle-formed surface. In the embodiment, the nozzle plate 30 of each head unit 20 includes a total of two nozzle rows 36, and the recording head 2 includes two head units 20. Thus, as illustrated in FIG. 5, the recording head 2 according to the embodiment has a total of four nozzle rows 36*a* to 36*d* arranged side by side in the main scanning direction. Of the nozzle rows 36, the above-described special-type ink is allocated to the third nozzle row 36*c* (i.e., in FIG. 5, one of the nozzle rows 36 to which black-dot nozzles 35 belong) while other inks are allocated to the nozzle rows 36*a*, 36*b*, and 36*d*.

Figure 6:
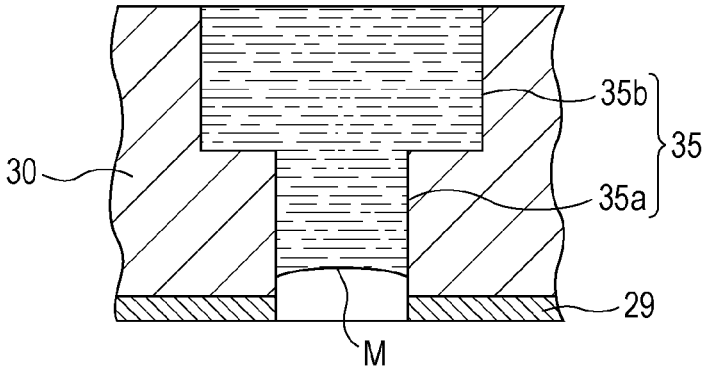
FIG. 6 is a cross-sectional view illustrating a configuration of a nozzle.

FIG. 6 is a cross-sectional view illustrating one of the nozzles 35. Note that a portion indicated by the letter M in FIG. 6 represents a meniscus that is the surface of ink inside a nozzle 35. The nozzle 35 according to the embodiment has a two-tier structure having a first nozzle portion 35*a* located downstream in the ink discharging direction (i.e., in the central axis direction of the nozzle) and a second nozzle portion 35*b* located upstream (i.e., on the side near a pressure chamber 37, which will be described below). The nozzle 35 can be formed, for example, by performing dry etching on a base material of the nozzle plate 30 that is made of a silicon substrate. The first nozzle portion 35*a* and the second nozzle portion 35*b* look like true circles when viewed in plan view, and the cross-sectional area of flow channel of the first nozzle portion 35*a* is smaller than that of the second nozzle portion 35*b*. Ink droplets (i.e., types of liquid droplets) are discharged from the opening of the first nozzle portion 35*a* that is located downstream of the second nozzle portion 35*b* in the ink discharging direction. Here, "true circles" as used above includes more or less imperfect circles as well as perfect circles. In other words, the true circles include circles that can be generally recognized as substantially true circles when viewed in plan view. Note that the nozzle 35 is not limited to the nozzle exemplified by the embodiment. Nozzles that can be adopted as the nozzles 35 may include various different configurations such as, for example, stepless nozzles that have a cylindrical shape and a substantially constant inner diameter or nozzles that have a tapered second nozzle portion 35*b* with a cross-sectional diameter of the flow channel being gradually reduced from the upstream side to the downstream side.

The liquid repellent film 29, which is made of a molecular film in which metal alkoxide polymerizes, is formed on the nozzle-formed surface of the recording head 2 with a foundation coating (not shown) sandwiched therebetween. In other words, in the embodiment, the liquid repellent film is formed on the bottom surface of the head cover 23 and on the nozzle plate 30 that is exposed in the opening 28 of the head cover 23. The liquid repellent film 29 is formed by applying a liquid repellent agent including fluorine (i.e., a silane coupling agent). As the liquid repellent agent, a silane compound including a fluoroalkyl group, for example, (3,3,3-trifluoropropyl) trimethoxysilane, can be used. Alternatively, instead of application of the liquid repellent agent, the liquid repellent film 29 may be formed by vapor deposition or spin coating. In the embodiment, the liquid repellent film 29 is formed on the periphery of the opening of the nozzle 35 on the nozzle-formed surface. Note that the liquid repellent film 29 may be formed partially on the inner surface of the nozzle 35, but the area of this portion is preferably as small as possible.

The flow-path substrate 31 are divided by a plurality of partition walls into a plurality of pressure chambers 37 that correspond to respective nozzles 35. Common liquid chambers 38 are formed outside of the rows of the pressure chambers 37 in the flow-path substrate 31. The common liquid chambers 38 are in communication with the pressure chambers 37 via ink supply ports 42. Ink is introduced into the common liquid chambers 38 from ink cartridges via ink introduction paths 39 in the case 33. Piezoelectric devices 32 (i.e., types of actuators) are formed on the top surface of the flow-path substrate 31, i.e., on the far-side surface from the nozzle plate 30, and an elastic membrane 40 is disposed between the piezoelectric devices 32 and the flow-path substrate 31. A piezoelectric device 32 is formed of a lower metal electrode film, a piezoelectric layer that is made, for example, of lead titanate zirconate, and an upper metal electrode film (these are not shown) by layering them successively. The piezoelectric device 32, which operates in the bending mode, is formed so as to cover an upper opening of a pressure chamber 37. In a head unit 20 according to the embodiment, two rows of piezoelectric devices, which correspond to a respective two of the nozzle rows 36, are formed side by side in the main scanning direction. The piezoelectric devices 32 are arranged in a staggered manner when viewed in the nozzle row direction. Each of the piezoelectric devices 32 deforms by applying an activation signal, which is sent through a wiring member 41, such as a flexible cable, from the printer controller 11. Thereby, ink is subjected to a pressure change in a pressure chamber 37 corresponding to each of the piezoelectric devices 32. By controlling the pressure change, ink is discharged from the nozzle 35.

Next, an activation pulse for activating a piezoelectric device 32 to discharge ink from a nozzle 35 will be described.

Figure 7:
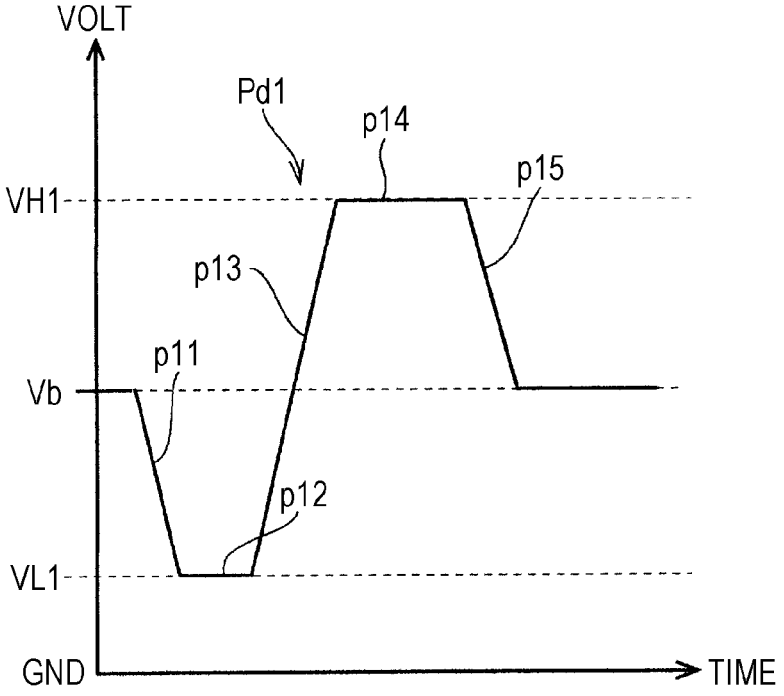
FIG. 7 is a waveform chart illustrating a configuration of a first activation pulse.

FIG. 7 is a waveform chart illustrating an example of a first activation pulse Pd1 (i.e., a type of "another activation pulse" in the invention) for discharging a relatively large ink droplet (i.e., a large dot) of the ink droplet sizes that can be discharged from the nozzle 35 of the recording head 2. The first activation pulse Pd1 according to the embodiment includes a first preliminary expansion component p11, a first expansion-hold component p12, a first contraction component p13, a first contraction-hold component p14, and a first recovery expansion component p15. The first preliminary expansion component p11 is a waveform portion in which the electric potential changes to negative polarity (i.e., a first polarity), i.e., from a reference potential Vb to a first expansion potential VL1 that is lower than the reference potential Vb. Note that a state in which the reference potential Vb is applied to the piezoelectric device 32 is an initial state, in which a meniscus in the nozzle 35 is located at an initial position (for example, the position indicated by the letter M in FIG. 6). The first expansion-hold component p12 is a waveform portion in which the first expansion potential VL1, which is the electric potential at the end of the first preliminary expansion component p11, is maintained for a certain period of time. The first contraction component p13 is a waveform portion in which the electric potential changes relatively steeply to positive polarity (i.e., a second polarity) from the first expansion potential VL1 to a first contraction potential VH1 past the reference potential Vb. The first contraction-hold component p14 is a waveform portion in which the first contraction potential VH1 is maintained for a predetermined period of time. The first recovery expansion component p15 is a waveform portion in which the electric potential recovers from the first contraction potential VH1 to the reference potential Vb.

Figure 8:
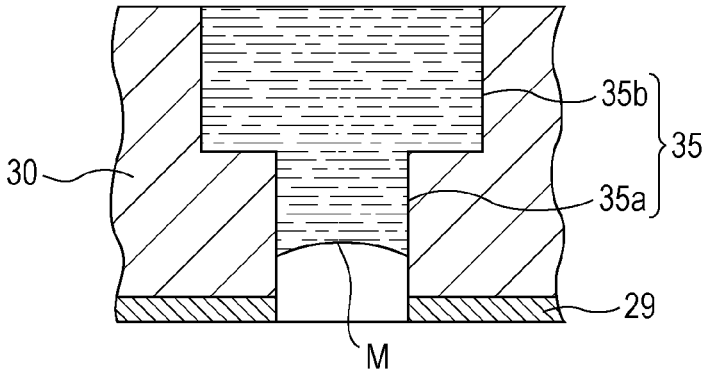
FIG. 8 is a view illustrating a process in which a liquid droplet is discharged from a nozzle.
Figure 9:
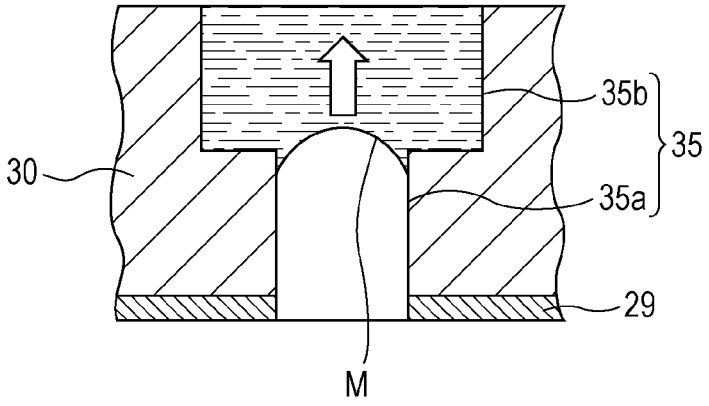
FIG. 9 is a view illustrating a process in which a liquid droplet is discharged from a nozzle.

FIGS. 8 to 12 are schematic views illustrating a process in which the piezoelectric device 32 is activated by the first activation pulse Pd1 and an ink droplet is discharged from the nozzle 35. FIG. 8 illustrates a state of the ink in the nozzle 35 before the first activation pulse Pd1 is applied to the piezoelectric device 32 (i.e., before ink is discharged). In this state, the reference potential Vb is continuously applied to the piezoelectric device 32 and the pressure change due to activation of the piezoelectric device 32 does not yet occur in the pressure chamber 37. Thus, the meniscus M in the nozzle 35 waits at the initial position (i.e., reference position) near the opening of the first nozzle portion 35*a* on the discharge side (i.e., on the far side from the pressure chamber 37). When the first activation pulse Pd1 is applied to the piezoelectric device 32 in this state, the first preliminary expansion component p11 first causes the piezoelectric device 32 to bend outward from the pressure chamber 37 (i.e., in a direction away from the nozzle 35). Following this, the pressure chamber 37 expands from a reference volume that corresponds to the reference potential Vb to a first expansion volume that corresponds to the first expansion potential VL1 (referred to as a first preliminary expansion process). As illustrated in FIG. 9, this expansion causes the meniscus M in the nozzle 35 to be pulled largely toward the pressure chamber 37 (i.e., upward in FIG. 9). Subsequently, this expansion state of the pressure chamber 37 is maintained by the first expansion-hold component p12 for a predetermined period of time (referred to as a first expansion-hold process).

Figure 10:
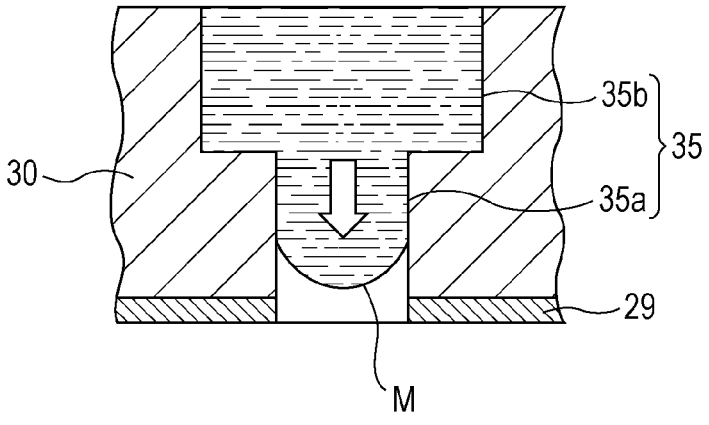
FIG. 10 is a view illustrating a process in which a liquid droplet is discharged from a nozzle.
Figure 11:
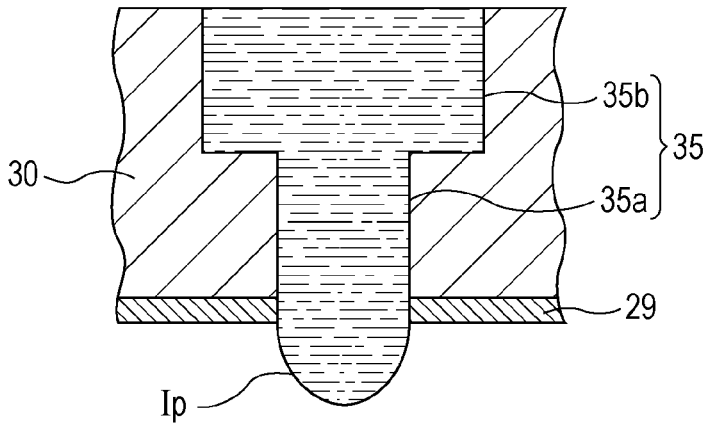
FIG. 11 is a view illustrating a process in which a liquid droplet is discharged from a nozzle.
Figure 12:
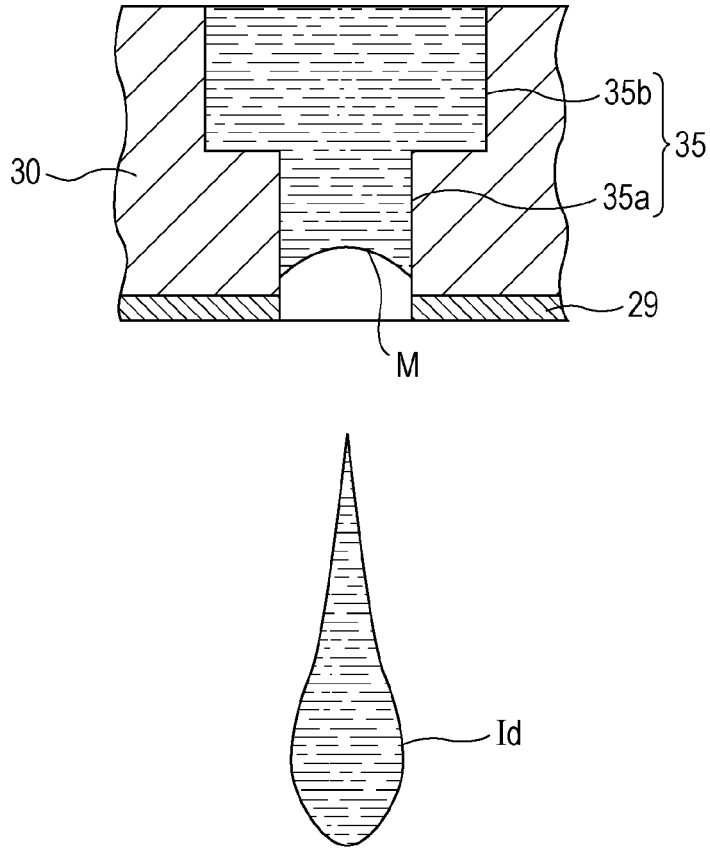
FIG. 12 is a view illustrating a process in which a liquid droplet is discharged from a nozzle.

After the expansion-hold process by the first expansion-hold component p12, the first contraction component p13 causes the piezoelectric device 32 to bend inward into the pressure chamber 37 (i.e., in a direction closer to the nozzle 35). Following this, the pressure chamber 37 contracts rapidly from the first expansion volume to a first contraction volume that corresponds to the first contraction potential VH1 (referred to as a first contraction process). Thereby, as illustrated in FIG. 10, the ink in the pressure chamber 37 is pressurized so as to push the meniscus M toward the discharge side (i.e., downward in the FIG. 10). Subsequently, the first contraction-hold component p14 is applied so as to maintain the contraction state of the pressure chamber 37 for a predetermined period of time (referred to as a first contraction-hold process). Meanwhile, the ink is pushed outward (i.e., toward the platen 5) due to inertia from the opening of the nozzle 35 on the nozzle-formed surface so as to form a liquid column Ip, as illustrated in FIG. 11. After the first contraction-hold component p14, the first recovery expansion component p15 is applied to the piezoelectric device 32, which displaces the piezoelectric device 32 to the reference position. Thereby, the pressure chamber 37 expands from the contraction volume to the reference volume. As illustrated in FIG. 12, while the liquid column Ip is being extended by an inertia force in the discharge direction, the meniscus M is pulled in a direction opposite the discharge direction. This causes the liquid column Ip to separate from the meniscus M and to fly toward a recording medium as an ink droplet Id. Thus, when ink is discharged from the nozzle 35 by the first activation pulse Pd1, the meniscus M moves to a position relatively closer to the liquid repellent film 29 and the whole portion of the meniscus M is discharged as an ink droplet. Thus, the ink that is discharged from the nozzle 35 by the first activation pulse Pd1 is susceptible to the influence of the state (i.e., degree of degradation) of the liquid repellent film 29.

Figure 13:
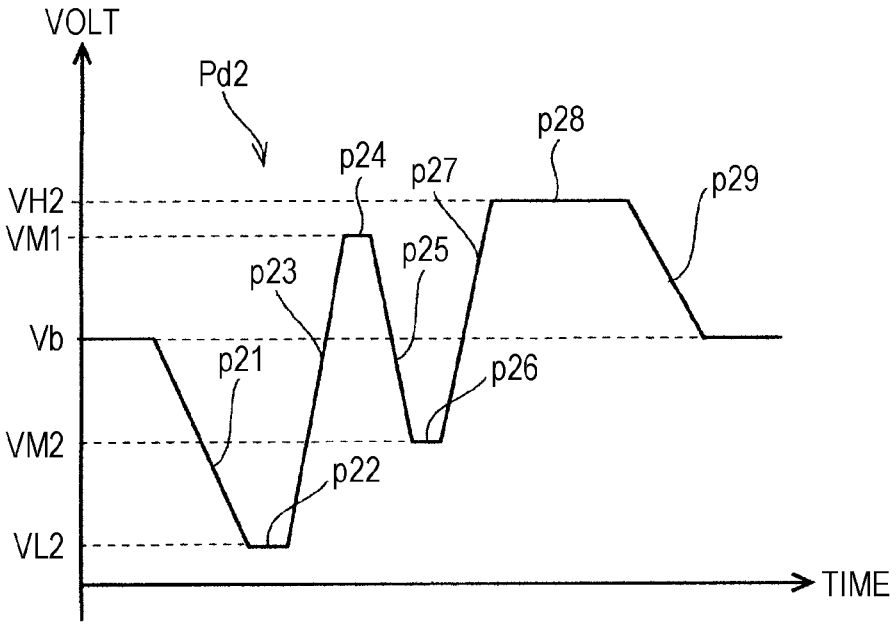
FIG. 13 is a waveform chart illustrating a configuration of a second activation pulse.

FIG. 13 is a waveform chart illustrating an example of a second activation pulse Pd2 (i.e., a type of activation pulse in the invention) for discharging a smaller ink droplet (i.e., a small dot) of the ink droplet sizes that can be discharged from the nozzle 35 of the recording head 2. The second activation pulse Pd2 according to the embodiment includes a second preliminary expansion component p21 (corresponding to a first pull-in component in the invention), a second expansion-hold component p22, a second contraction component p23 (corresponding to a first push-out component in the invention), a first intermediate-hold component p24, and a re-expansion component p25 (corresponding to a second pull-in component in the invention), a second intermediate-hold component p26, a re-contraction component p27 (corresponding to a second push-out component in the invention), a re-contraction-hold component p28, and a second recovery expansion component p29.

The second preliminary expansion component p21 is a waveform component in which the electric potential changes (or drops) at a constant rate to the negative polarity (or the first polarity), i.e., from the reference potential Vb to a second expansion potential VL2 that is lower than the reference potential Vb. The second expansion-hold component p22 is a waveform component in which the second expansion potential VL2, which is the electric potential at the end of the second preliminary expansion component p21, is maintained for a certain period of time. The second contraction component p23 is a waveform component in which the electric potential changes (or rises) to the positive polarity (or the second polarity) from the second expansion potential VL2 to a first intermediate contraction potential VM1 that is higher than the reference potential Vb. The first intermediate contraction-hold component p24 is a waveform component in which the first intermediate contraction potential VM1 is maintained for a certain period of time. The re-expansion component p25 is a waveform component in which the electric potential drops again from the first intermediate contraction potential VM1 to the second intermediate potential VM2 that is lower than the reference potential Vb and higher than the second expansion potential VL2. The second intermediate-hold component p26 is a waveform component in which the second intermediate potential VM2 is maintained for a certain period of time. The re-contraction component p27 is a waveform component in which the electric potential changes to the positive polarity from the second intermediate potential VM2 to a second contraction potential VH2 that is higher than the first intermediate contraction potential VM1. The re-contraction-hold component p28 is a waveform component in which the second contraction potential VH2 is maintained for a certain period of time. The second recovery expansion component p29 is a waveform component in which the electric potential recovers from the second contraction potential VH2 to the reference potential Vb.

Figure 14:
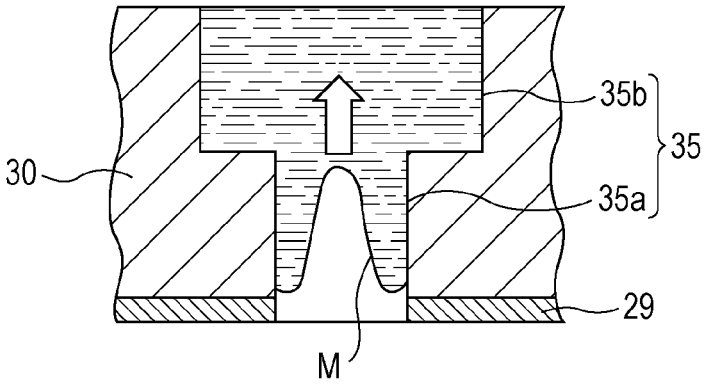
FIG. 14 is a view illustrating a process in which a liquid droplet is discharged from a nozzle.
Figure 15:
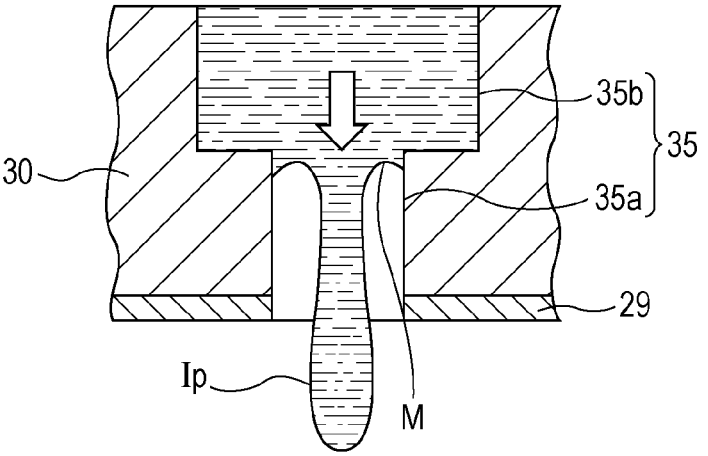
FIG. 15 is a view illustrating a process in which a liquid droplet is discharged from a nozzle.
Figure 16:
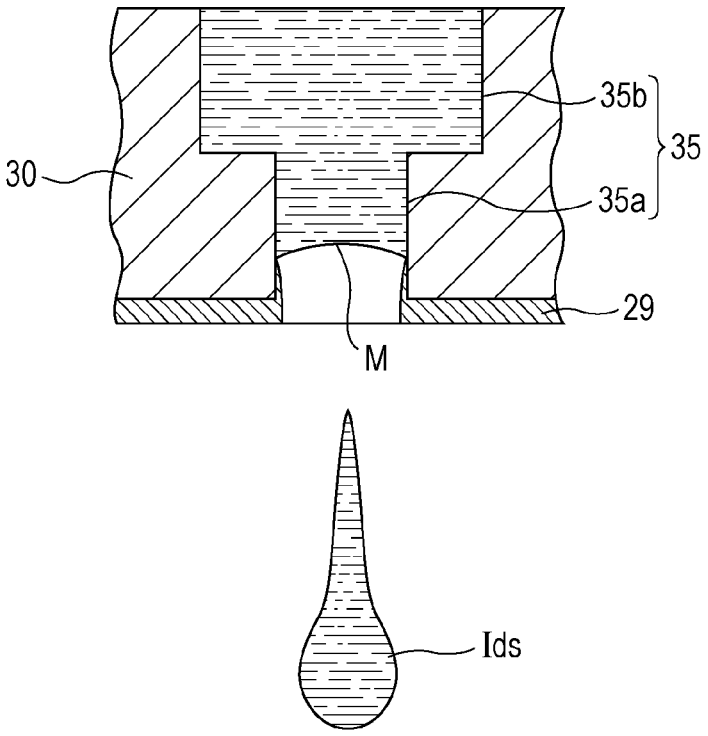
FIG. 16 is a view illustrating a process in which a liquid droplet is discharged from a nozzle.

FIGS. 14 to 16 are views illustrating a process in which the piezoelectric device 32 is activated by the second activation pulse Pd2 and an ink droplet is discharged from the nozzle 35. Note that when the second activation pulse Pd2 is applied to the piezoelectric device 32 consecutively from the second preliminary expansion component p21 to the second contraction component p23, the meniscus M in the nozzle 35 exhibits behavior similar to that when the first activation pulse Pd1 is applied to the piezoelectric device 32 consecutively from the first preliminary expansion component p11 to the first contraction component p13. Thus, FIGS. 14 to 16 illustrate the behavior of the meniscus M that is different from what has been exhibited with the first activation pulse Pd1.

The second activation pulse Pd2 is applied to the piezoelectric device 32 in the state in which the meniscus M in the nozzle 35 waits at the initial position (i.e., reference position) in the vicinity of the discharge-side opening of the first nozzle portion 35*a*. The second preliminary expansion component p21 first causes the piezoelectric device 32 to bend outward from the pressure chamber 37. Following this, the pressure chamber 37 expands from the reference volume that corresponds to the reference potential Vb to a second expansion volume that corresponds to the second expansion potential VL2 (referred to as a second preliminary expansion process). This expansion causes the meniscus M in the nozzle 35 to be pulled largely toward the pressure chamber 37 (see FIG. 9). This expansion state of the pressure chamber 37 is maintained by the second expansion-hold component p22 for a predetermined period of time (referred to as a second expansion-hold process).

After the expansion-hold process by the second expansion-hold component p22, the second contraction component p23 causes the piezoelectric device 32 to bend inward into the pressure chamber 37. Following this, the pressure chamber 37 contracts from the second expansion volume to an intermediate contraction volume that corresponds to the first intermediate contraction potential VM1 (referred to as a second contraction process). Thereby, the ink in the pressure chamber 37 is pressurized so as to push the meniscus M toward the discharge side (see FIG. 10). Here, the second preliminary expansion component p21 and the second contraction component p23 are preliminary waveforms that raises the internal pressure (i.e., ink pressure) in the pressure chamber 37. Subsequently, the first intermediate-hold component p24 is applied to the piezoelectric device 32 so as to maintain the contraction state of the pressure chamber 37 for a period of time that is shorter than that in the first contraction-hold component p14 (referred to as an intermediate contraction-hold process).

Next, applying the re-expansion component p25 to the piezoelectric device 32 causes the piezoelectric device 32 to bend outward from the pressure chamber 37. Following this, the pressure chamber 37 expands again from the intermediate contraction volume to an intermediate expansion volume that corresponds to the second intermediate potential VM2 (referred to as a re-expansion process). Here, in the nozzle 35, a central portion of the ink, which is less influenced by the inner surface of the nozzle, responds to pressure changes in the pressure chamber 37 and moves more readily while a portion of the ink that is near the inner surface of the nozzle is more sluggish to respond to pressure changes due to the influence of viscosity, and thus the portion of the ink moves more slowly. As a result, as illustrated in FIG. 14, the central portion of the meniscus M is pulled again toward the pressure chamber 37 while the portion of the meniscus M that is near the inner surface of the nozzle 35 stays closer to the discharge side than the central portion. This expansion state of the pressure chamber 37 is maintained by the second intermediate-hold component p26 for a predetermined period of time (referred to as a re-expansion-hold process).

After the re-expansion-hold process, the re-contraction component p27 causes the piezoelectric device 32 to bend more largely inward into the pressure chamber 37. Following this, the pressure chamber 37 contracts rapidly from the intermediate expansion volume to a second contraction volume that corresponds to the second contraction potential VH2 (referred to as a re-contraction process). Thereby, the ink in the pressure chamber 37 is pressurized, and, as illustrated in FIG. 15, the central portion of the meniscus M that is more susceptible to the pressure changes is pushed toward the discharge side so as to form a liquid column Ip. The contraction state of the pressure chamber 37 is maintained by the re-contraction-hold component p28 for a predetermined period of time (referred to as a re-contraction-hold process). In the meantime, the liquid column Ip extends toward the discharge side due to inertia. After the re-contraction-hold process, the second recovery expansion component p29 is applied to the piezoelectric device 32, which displaces the piezoelectric device 32 to the reference position. Thereby, the pressure chamber 37 expands from the second contraction volume to the reference volume. As illustrated in FIG. 16, while the liquid column Ip is being extended by an inertia force in the discharge direction, the meniscus M is pulled in a direction opposite the discharge direction. This causes the liquid column Ip to be separated from the meniscus M, and the separated portion flies toward a recording medium as an ink droplet Ids that is smaller than the ink droplet Id discharged by the first activation pulse Pd1.

Thus, in the process in which the nozzle 35 discharges an ink droplet by applying the second activation pulse Pd2, the meniscus M is located more upstream (i.e., closer to the pressure chamber 37) compared with the process using the first activation pulse Pd1, and the central portion of the meniscus M is primarily discharged as the ink droplet. As a result, ink is less likely to be brought into contact with the liquid repellent film 29 during the discharge. Thus, in the embodiment, when the nozzle 35 discharges the special-type ink that tends to damage the repellency of the liquid repellent film 29 as described above, the piezoelectric device 32 that corresponds to the nozzle 35 is configured to be activated exclusively by the second activation pulse Pd2. By doing so, even if the liquid repellent film 29 surrounding the nozzle 35 that discharges the special-type ink deteriorates (i.e., the repellency is damaged) due to adhesion of the special-type ink, the nozzle 35 can discharge the special-type ink without being influenced by the change in repllency of the liquid repellent film 29 due to the deterioration. On the other hand, other nozzles 35 that discharge inks other than the special-type ink are operated by selectively applying, in principle, various activation pulses that include the first activation pulse Pd1 and the second activation pulse Pd2 depending on required gradations for recording. Note that the nozzle 35 that discharges the special-type ink is operated in principle by applying the second activation pulse Pd2. However, this does not exclude use of a configuration in which the nozzle 35 is operated by applying an activation pulse other than the second activation pulse Pd2 in exceptional cases rather than the recording operation for recording images, etc. This configuration is used, for example, during flushing processing for flushing viscous ink around the nozzle 35 and bubbles.

An activation pulse that functions as the activation pulse according to the invention is one that includes the first pull-in component, the first push-out component, the second pull-in component, and the second push-out component and that can pull the meniscus M in the nozzle 35 more deeply toward the upstream side and can primarily discharge the center portion of the meniscus M from the nozzle 35. Thus, as far as the activation pulse for the special-type liquid satisfy these conditions, the activation signal generation circuit 15 may be formed so as to generate a plurality of activation pulses for the special-type liquid, by which the nozzle 35 discharges a different liquid amount of an ink droplet. This enables recording with multiple gradations by selectively applying these activation pulses for the special-type liquid to the piezoelectric device 32. However, it is sufficient that a liquid discharging apparatus using the special-type liquid at least has a configuration for generating an activation pulse that includes the first pull-in component, the first push-out component, the second pull-in component, and the second push-out component and that can pull the meniscus M in the nozzle 35 more deeply toward the upstream side and can primarily discharge the center portion of the meniscus M from the nozzle 35.

Note that if ink droplets are discharged by applying the second activation pulse Pd2 in a case where the first activation pulse Pd1 is normally to be used, the amount of ink that strikes a recording medium decreases. In this case, the number of ink discharges per a predetermined region (i.e., a pixel region or a unit for forming an image, etc.) is to be increased accordingly.

In addition, the second activation pulse Pd2 is not limited to use in recording operation for recording images, etc., on a recording medium. Also in so-called flushing processing in which the nozzles 35 is forced to discharge ink droplets so as to recover an ink discharging capability, it is desirable that the second activation pulse Pd2 be applied to the nozzles 35 that discharge the special-type ink or to the nozzles 35 that has satisfied a pulse-switching condition, which will be described below.

The liquid repellent film 29 in the vicinity of the nozzles 35 that discharge inks other than the special-type ink may deteriorates gradually. For example, in the configuration in which the nozzle-formed surface is swept (or wiped) by the wiper 9 of the wiping mechanism 7, the special-type ink may cause deterioration of the liquid repellent film 29 surrounding the nozzles 35 that discharge other inks, depending on the arrangement of the nozzle rows 36 and the wiping direction of the wiper 9. Moreover, in the configuration in which the nozzle-formed surface is sealed by the cap 8 of the capping mechanism 6, ink tends to remain on a contact portion on the nozzle-formed surface that comes into contact with the cap 8. The special-type ink deposited on the contact portion may be spread over the nozzle-formed surface by wiping and may cause deterioration of the liquid repellent film 29 surrounding the nozzles 35 that discharge other inks. Measures for preventing this will be described below.

As indicated by the black arrow in FIG. 5, in the configuration in which the wiper 9 sweeps the nozzle-formed surface in the row arrangement direction of the nozzle rows 36 (i.e., the main scanning direction of the recording head 2), the special-type ink of the third nozzle row 36*c* may be spread over the nozzle-formed surface by wiping and may cause deterioration of the liquid repellent film 29 surrounding the nozzles 35 in the first nozzle row 36*a* and in the second nozzle row 36*b*, which are located downstream of the third nozzle row 36*c* in the wiping direction. Especially in the configuration in which the nozzle-formed surface is sealed (or capped) by the capping mechanism 6, ink tends to adhere to a contact portion on the nozzle-formed surface that comes into contact with the cap 8. In this configuration, whether the cap 8 is a cap that covers all the nozzle rows 36 of the recording head 2 (the contact portion on the nozzle-formed surface with this cap 8 is indicated by Lm1 in FIG. 5) or a cap that covers each of the head units 20 (the contact portion on the nozzle-formed surface with this cap 8 is indicated by Lm2 in FIG. 5), the special-type ink deposited on the nozzle-formed surface moves downstream by wiping. To cope with this situation, the first nozzle row 36*a* and the second nozzle row 36*b* discharge ink by applying, in principle, various activation pulses in accordance with required gradations for recording until a predetermined pulse-switching condition is satisfied. After the pulse-switching condition is satisfied, these nozzle rows discharge ink by exclusively using the second activation pulse Pd2. By doing so, even if the liquid repellent film 29 surrounding the nozzles 35 that discharges inks other than the special-type ink deteriorates (i.e., the repellency is damaged) by wiping repeatedly, these nozzles 35 can discharge ink without being influenced by the change in repellency of the liquid repellent film 29 due to the deterioration.

Regarding the pulse-switching condition, for example, a threshold value for the number of wipes is set in advance when the printer 1 is shipped. The pulse-switching condition can be set as whether the number of wipes exceeds the threshold value or not. It is desirable that the pulse-switching condition be set differently in accordance with the rate of progress of deterioration of the liquid repellent film 29. In other words, it is desirable that for nozzles 35 that are located where the liquid repellent film 29 tends to deteriorate more rapidly, the pulse-switching condition be set to have a smaller value so as to satisfy it earlier. On the other hand, it is also desirable that for nozzles 35 that are located where the liquid repellent film 29 tends to deteriorate more slowly, the pulse-switching condition is set to have a larger value so as to satisfy it more slowly. By doing this, more timely switching to the activation using the second activation pulse Pd2 can be achieved. Instead of using the pulse-switching condition, the first nozzle row 36*a* and the second nozzle row 36*b* may be configured to discharge ink by applying the second activation pulse Pd2 from the beginning.

Regarding the fourth nozzle row 36*d* that is located upstream of the third nozzle row 36*c* with respect to the wiping direction, the liquid repellent film 29 surrounding the nozzles 35 in the fourth nozzle row 36*d* may also deteriorate by wiping repeatedly. Especially in the configuration in which the nozzle-formed surface is capped by the capping mechanism 6, ink tends to adhere to the contact portion on the nozzle-formed surface that comes into contact with the cap 8. In the configuration in which the wiping direction is the row arrangement direction of the nozzle rows 36, the fourth nozzle row 36*d* shares the same cap 8 with the third nozzle row 36*c*, irrespective of whether the cap 8 is a cap that covers all the nozzle rows 36 of the recording head 2 or a cap that covers each of the head units 20. Thus, repeated wiping may likely cause deterioration of the liquid repellent film 29 that surrounds the nozzles 35 in the fourth nozzle row 36*d* due to the special-type ink. Moreover, when the third nozzle row 36*c* and the fourth nozzle row 36*d* are capped by the common cap 8 while a portion of the ink discharged from each nozzle 35 stays inside the cap 8, the nozzles 35 in the fourth nozzle row 36*d* may be continuously exposed to the special-type ink, and the deterioration of the liquid repellent film 29 may progress. To cope with this situation, it is desirable that the fourth nozzle row 36*d* be configured to use a pulse-switching condition independently of the pulse-switching conditions set for the first nozzle row 36*a* and the second nozzle row 36*b* that are located downstream. Thus, the fourth nozzle row 36*d* discharges ink by applying, in principle, various activation pulses in accordance with required gradations for recording until the pulse-switching condition is satisfied and then discharges ink by exclusively using the second activation pulse Pd2 after the pulse-switching condition is satisfied.

Moreover, in the configuration in which wiping is performed in the nozzle arrangement direction in a row, as indicated by the solid-white arrow in FIG. 5, the liquid repellent film 29 surrounding the nozzles 35 in the nozzle row 36 that shares the wiper 9 during wiping with the third nozzle row 36*c* that discharges the special-type ink may deteriorate. For example, as illustrated in FIG. 5, a first wiper 9*a* is configured to simultaneously wipe the first nozzle row 36*a* and the second nozzle row 36*b*, and a second wiper 9*b* to simultaneously wipe the third nozzle row 36*c* and the fourth nozzle row 36*d*. In this configuration, if the head units 20 use respective caps, the special-type ink adheres to the second wiper 9*b* and may cause deterioration of the liquid repellent film 29 surrounding the nozzles 35 in the fourth nozzle row 36*d*. In this configuration, the nozzles 35 in the first nozzle row 36*a* and the second nozzle row 36*b* discharge ink by applying, in principle, various activation pulses in accordance with required gradations for recording. On the other hand, it is desirable that a predetermined pulse-switching condition be set to the fourth nozzle row 36*d*. Thus, the fourth nozzle row 36*d* discharges ink by selectively applying, in principle, various activation pulses in accordance with required gradations for recording until the predetermined pulse-switching condition is satisfied. After the pulse-switching condition is satisfied, the fourth nozzle row 36*d* discharges ink by exclusively using the second activation pulse Pd2. Whether the number of wipes exceeds a predetermined threshold value or not can be set as the pulse-switching condition.

Moreover, in the case in which the first wiper 9*a* is configured to simultaneously wipe the first nozzle row 36*a* and the second nozzle row 36*b* and the second wiper 9*b* to simultaneously wipe the third nozzle row 36*c* and the fourth nozzle row 36*d*, if a common cap 8 covers all the nozzle rows 36, the special-type ink that adheres to the contact portion Lm1 on the nozzle-formed surface with the cap 8 may cause deterioration of the liquid repellent film 29 surrounding the nozzles 35 in the nozzle rows 36*a*, 36*b*, and 36*d* in addition to the third nozzle row 36*c*. In this configuration, it is desirable that a predetermined pulse-switching condition be set to these nozzle rows 36*a*, 36*b*, 36*d* and these nozzle rows discharge ink by selectively applying, in principle, various activation pulses in accordance with required gradations for recording until the predetermined pulse-switching condition is satisfied. After the pulse-switching condition is satisfied, these nozzle rows discharge ink by exclusively using the second activation pulse Pd2.

In addition, in a configuration in which all the nozzle rows 36*a* to 36*d* are wiped together by a common third wiper 9*c*, the special-type ink from the third nozzle row 36*c* is spread over the nozzle-formed surface by wiping, irrespective of whether the cap 8 is a cap that covers all the nozzle rows 36 of the recording head 2 or a cap that covers each of the head units 20. This may cause deterioration of the liquid repellent film 29 surrounding the nozzles 35 in the first nozzle row 36*a*, the second nozzle row 36*b*, and the fourth nozzle row 36*d*. In this configuration, it is desirable that a predetermined pulse-switching condition be also set to these nozzle rows 36*a*, 36*b*, 36*d* and these nozzle rows discharge ink by exclusively using the second activation pulse Pd2 after the pulse-switching condition is satisfied.

Moreover, as illustrated in FIG. 5, a plurality of inks are allocated to one nozzle row 36, for example, in such a manner that the third nozzle row 36*c* is divided into three nozzle groups represented by X, Y, and Z, in which the special-type ink is allocated to the nozzle group Y and other inks are allocated to the nozzle groups X and Z. In this configuration, the special-type ink is more likely to cause deterioration of the liquid repellent film 29 surrounding the nozzles 35 in the nozzle group X, which is located downstream of the nozzle group Y in the wiping direction. Thus, it is desirable that a predetermined pulse-switching condition be also set to the nozzles 35 in the nozzle group X, and these nozzles discharge ink by exclusively using the second activation pulse Pd2 after the pulse-switching condition is satisfied. Repeated wiping causes the special-type ink to gradually stain the wiper 9 and the nozzle group Z that is located upstream of the nozzle group Y with respect to the wiping direction and also to stain other nozzle rows 36 that share the same cap 8 with the third nozzle row 36*c*. This may cause deterioration of the liquid repellent film 29 surrounding the nozzles 35 in the nozzle group Z and in the fourth nozzle row 36*d*. Thus, it is desirable that a predetermined pulse-switching condition be also set to the nozzle group Z and other nozzle rows 36 that share the same cap 8 with the third nozzle row 36*c*, and these nozzles discharge ink by exclusively using the second activation pulse Pd2 after the pulse-switching condition is satisfied.

As described above, in the printer 1 according to the invention, even if the liquid repellent film 29 surrounding the nozzles 35 of the recording head 2 is deteriorates, the nozzles 35 can discharge the special-type ink or other inks without being influenced by the deterioration. Thus, the reliability in ink discharge in the printer 1 can be maintained for a longer period of time.

Note that in the above embodiments, the actuator is exemplified as a so-called bending vibration type of piezoelectric device 32, but the actuator is not limited to this type. For example, a so-called vertical vibration type of piezoelectric device can be adopted as the actuator. In this case, the second activation pulse Pd2 exemplified in the above embodiments will exhibit a waveform in which the potential change direction, i.e., the upper side and lower side in polarity, is inverted. The actuator is not limited to a piezoelectric device. Other actuators, such as heating devices and electrostatic actuators, can be adopted.

The invention is not limited to apply to the printer 1 but to various ink jet type recording apparatuses, such as plotters, facsimile machines, copying machines, etc., and to liquid discharging apparatuses, such as textile-printing apparatuses that perform textile printing by discharging ink from a liquid discharging head onto a piece of cloth (i.e., textile material to print on) as an ink landing target, and to other apparatuses of the kind. In short, the invention is preferable for devices that include the liquid repellent film formed on the nozzle-formed surface of the liquid discharging head and that discharge a type of liquid that may cause the liquid repellent film to deteriorate.

What is claimed is:

1. A liquid discharging apparatus, comprising:

a liquid discharging head having an actuator, a nozzle-formed surface on which a nozzle opens and discharging liquid from the nozzle by activating the actuator; and an activation pulse generation circuit that generates an activation pulse for activating the actuator, wherein the nozzle-formed surface has a liquid repellent film formed thereon, the activation pulse includes a first pull-in component that pulls a meniscus in the nozzle from an initial position of the meniscus toward an upstream side with respect to a discharge direction, a first push-out component that pushes, toward a downstream side with respect to the discharge direction, the meniscus that has been pulled, a second pull-in component that pulls, toward the upstream side again, the meniscus that has been pushed, and a second push-out component that pushes, toward the downstream side again, at least a portion of the meniscus that has been pulled again, and the actuator corresponding to the nozzle that discharges a special-type liquid among liquids to be discharged by the liquid discharging head is activated by the activation pulse, the special-type liquid being a type of liquid that relatively tends to cause repellency of the liquid repellent film to deteriorate, wherein the actuator corresponding to the nozzle that discharges other liquids is activated by the activation pulse or another activation pulse until a predetermined pulse-switching condition is satisfied and, after the predetermined pulse-switching condition is satisfied, the actuator is exclusively activated by the activation pulse, and wherein a sweeping mechanism that sweeps the nozzle-formed surface is provided, wherein the pulse-switching condition is a predetermined number of wipes to be performed on the nozzle-formed surface by the sweeping mechanism.

2. The liquid discharging apparatus according to claim 1, wherein the special-type liquid has a static contact angle with the liquid repellent film and the static contact angle is smaller than the static contact angle of the other liquids.

3. The liquid discharging apparatus according to claim 1, wherein the special-type liquid is a liquid to which foreign matter tends to adhere compared with the other liquids.

4. The liquid discharging apparatus according to claim 1, wherein the special-type liquid contains a pigment or an inorganic material.

5. The liquid discharging apparatus according to claim 1, wherein the special-type liquid is more corrosive to the liquid repellent film than the other liquids.

* * * * *